US005915557A

United States Patent [19]

Levine

[11] Patent Number: 5,915,557

[45] Date of Patent: Jun. 29, 1999

[54] TRANSPORTATION RING

[76] Inventor: Norman Levine, 4501 S. Santa Fe Ave., Vernon, Calif. 90058

[21] Appl. No.: 09/110,998

[22] Filed: Jul. 6, 1998

[51] Int. Cl.[6] ..... B65D 21/032

[52] U.S. Cl. ..... 206/509; 220/319; 206/821

[58] Field of Search ..... 220/319; 206/508, 206/509, 821

[56] References Cited

U.S. PATENT DOCUMENTS

| | | | |
|---|---|---|---|
| 2,899,096 | 8/1959 | Henchert et al. | 206/821 |
| 3,173,574 | 3/1965 | Goldsmith | 206/821 |
| 5,161,689 | 11/1992 | Balson | 206/509 |
| 5,174,464 | 12/1992 | Watt | 220/319 |
| 5,261,551 | 11/1993 | Watt | 220/319 |

FOREIGN PATENT DOCUMENTS

| | | | |
|---|---|---|---|
| 535383 | 4/1993 | European Pat. Off. | 220/319 |
| 815752 | 8/1951 | Germany | 220/319 |

*Primary Examiner*—Stephen Castellano
*Attorney, Agent, or Firm*—Edgar W. Averill, Jr.

[57] ABSTRACT

A transportation ring affixed to a container for the purpose of retaining the container plug on the container during transportation. The transportation ring snaps over the can seam and extends inwardly over the plug curl, but not downwardly below the plug cover portion. The ring is preferably fabricated from a rigid plastic material.

5 Claims, 2 Drawing Sheets

TRANSPORTATION RING

BACKGROUND OF THE INVENTION

The field of the invention is containers and the invention relates more particularly to transportation rings of the type used to hold the top on a can containing essentially hazardous and dangerous materials during shipping.

A transportation ring is shown in U.S. Pat. No. 5,193,705. This ring extends downwardly into the plug recess. A removable retaining device for cans is also shown in U.S. Pat. No. 4,728,003. This device also extends into the U-shaped plug or lid recess. A reclosable vacuum container has the lid captured in a peripheral sealing cavity as shown in U.S. Pat. No. 4,111,330.

U.S. Pat. No. 4,932,554 shows a lid retaining collar which also has a portion which extends into the U-shaped plug or lid recess.

While the prior art devices which extend into the U-shaped plug recess and onto the plug cover portion operate adequately, the applicant discovered it was not necessary to have these extensions to hold a lid or plug on a can and pass the applicable United Nations can testing requirements.

BRIEF SUMMARY OF THE INVENTION

It is an object of the present invention to provide a transportation ring which will hold a plug on a can during shipping of a heavier weight without extending into the U-shaped plug recess or onto the plug cover portion.

The present invention is for a transportation ring affixed to a container. The container has a can body extending upwardly to a seam which connects the can body to a can ring. The can ring has a ring wall, a U-shaped can ring recess having a can ring recess outer wall, a can ring recess inner wall terminating in a can ring curl. A plug or lid has a cover portion, plug bead and a U-shaped plug recess which fits into the U-shaped can ring recess. The transportation ring has an outer downwardly depending arm which surrounds an outer surface of the seam of the can between the can body and the ring. An inwardly directed locking protrusion extends inwardly from a lower portion of the outer downwardly depending arm and extends below the seam to hold the transportation ring on the container. An inwardly extending arm extends inwardly from an upper portion of the downwardly depending arm. A plug curl and bead contacting arm extends inwardly and downwardly from an inner end of the inwardly extending arm. This curl contacting arm extends inwardly to contact said plug bead and does not extend below the plug cover portion but does extend partially over the plug curl.

DESCRIPTION OF THE PREFERRED EMBODIMENTS

Figure 2:
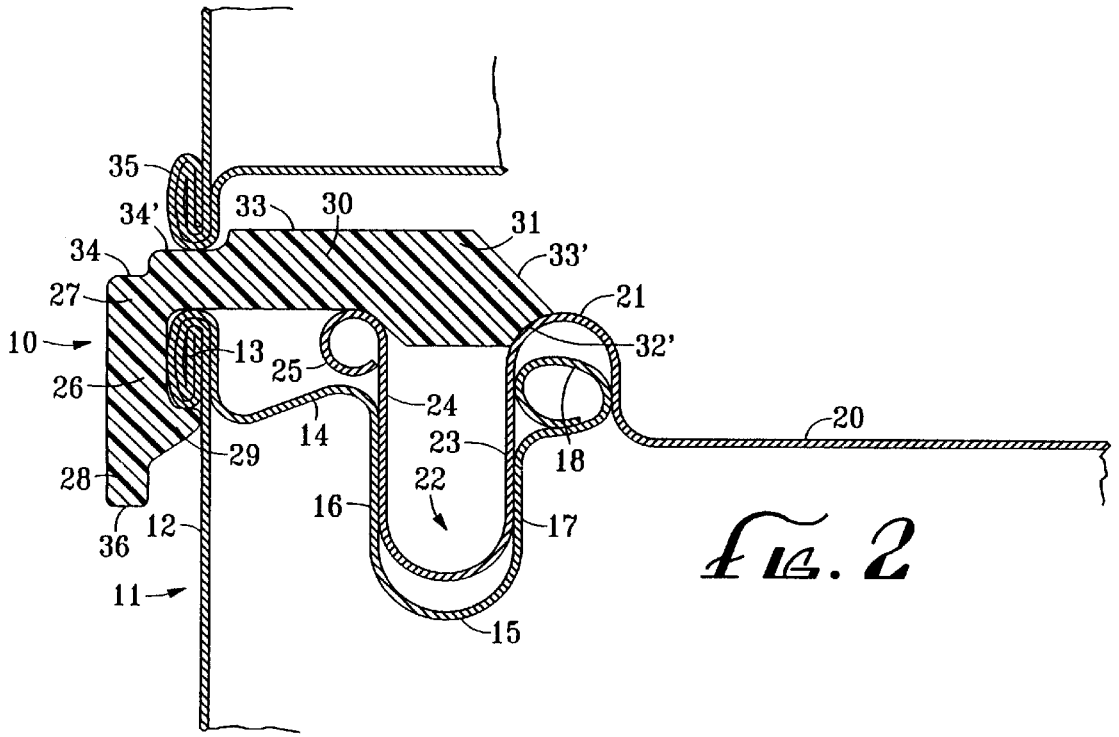
FIG. 2 is a cross-sectional view of the transportation ring affixed to the container.
Figure 1:
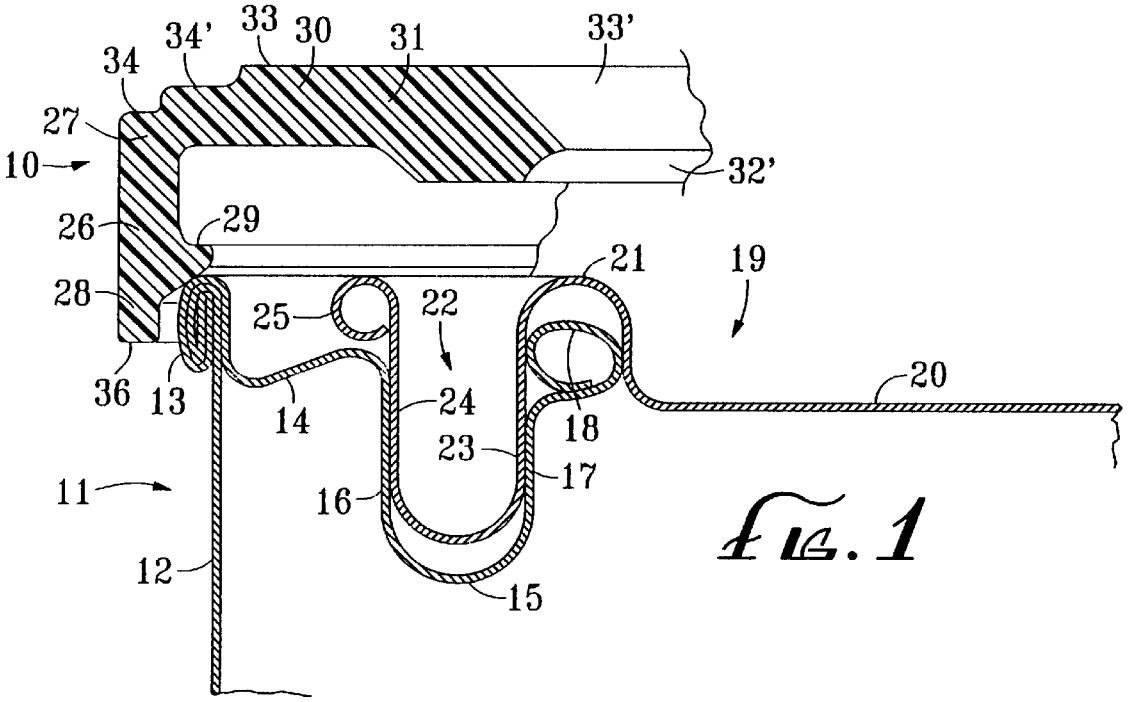
FIG. 1 is cross-sectional view of a container having a can body and a plug affixed thereto with the transportation ring positioned above the container.

The transportation ring 10 of the present invention is shown in FIGS. 1 and 2. In FIG. 1 it is shown touching a double seam 13 of container 11. Container 11 has a can body 12 which is affixed by the double seam 13 to a can ring 14. Can ring 14 has a U-shaped can ring recess 15 which has a can ring recess outer wall 16 and a can ring recess inner wall 17. Inner wall 17 extends upwardly to a can ring curl 18 which provides the inner edge of the opening of the container. A can lid or plug 19 has a cover portion 20 and a plug bead 21. Plug bead 21 extends downwardly into a U-shaped plug recess 22 which has an inner wall 23 and an outer wall 24. Outer wall 24 extends upwardly to a plug curl 25.

In FIG. 2 the transportation ring 10 has been snapped over double seam 13 onto the top of container 11. Transportation ring 10 has an outer downwardly depending arm 26. Outer arm 26 has an upper portion 27 and a lower portion 28. A lower inwardly directed seam locking protrusion 29 extends over double seam 13 and under the bottom of double seam 13 to hold the transportation ring 10 over the container.

Transportation ring 10 has an upper inwardly extending arm 30 which extends inwardly from upper portion 27 of outer, downwardly depending arm 26. Upper, inwardly extending arm 30 extends to an inner area 31 from which a plug curl and plug bead contacting arm 32 depends inwardly and downwardly. Plug curl and bead contacting arm 32 contacts plug curl 25 and plug bead 21 and as pressure within the container builds tends to hold the U-shaped plug recess 22 into U-shaped can ring recess 15. Whereas it had been believed that it was necessary to extend the transportation ring substantially into U-shaped plug recess 22, it has been found that this is not the case. The present invention ring can provide all the transportation safety necessary.

Preferably the plug curl and bead contacting arm 32 extends at an angle of about 45° from the horizontal. Also preferably the inwardly extending arm 30 has a flat planer portion 33 and a pair of recess portions 34 and 34'. The angled surface 33' extends down to the concave plug bead contacting surface 32'. Recess portion 34' permits the bottom double seam 35 of an upper container to rest securely on top of transportation ring 10 of the lower container. Recess portion 34 facilitates the stacking of transportation rings.

It is also beneficial that the transportation ring have a downwardly depending portion 36 to facilitate the removal of the ring when desired.

The transportation ring of the present invention is preferably fabricated from a rigid polymer such as high density polyethylene. It is important that the plug curl and bead contacting arm 32 extend past the plug curl 25 to at least about touch the plug head 21. It need not extend any significant distance into the plug recess 22. It preferably has a concave shaped recess 32' which mates with the outer surface of plug bead 21.

Figure 3:
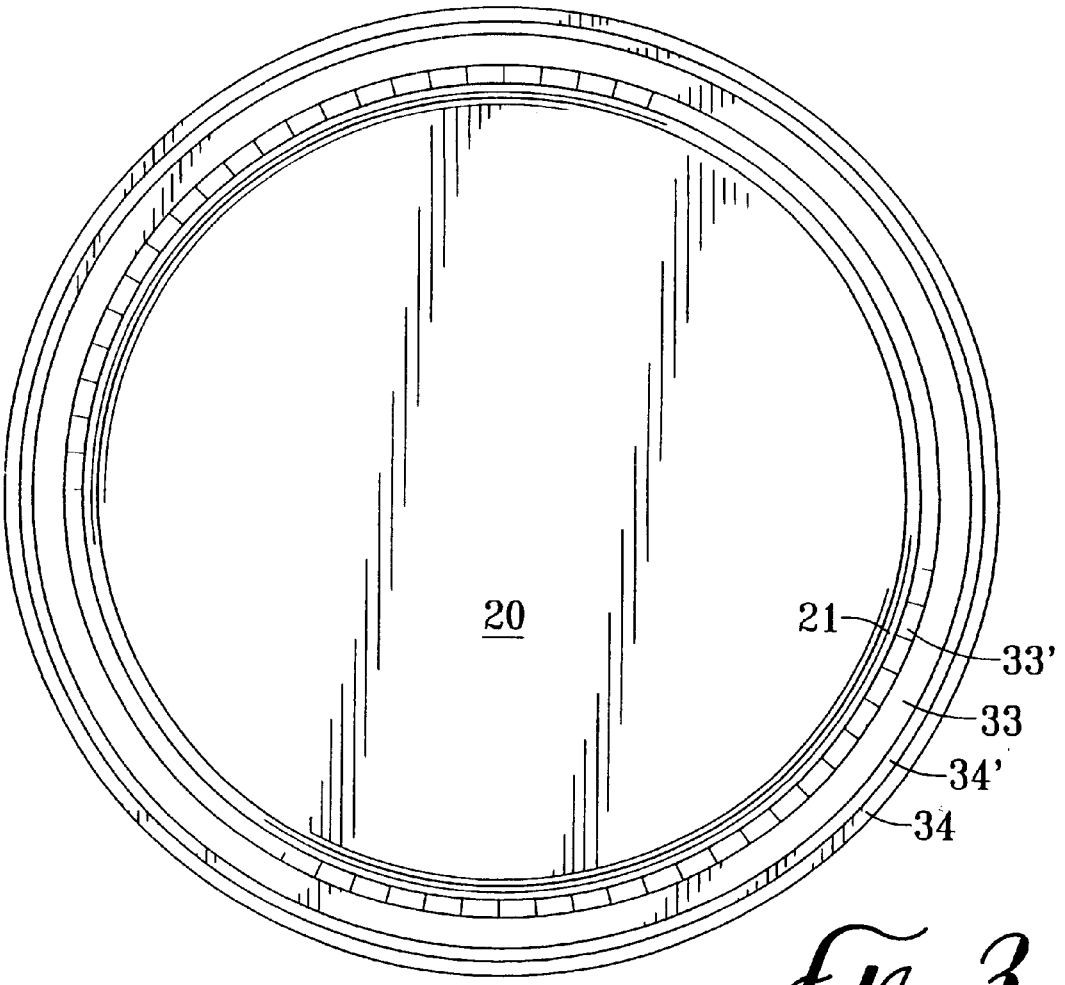
FIG. 3 is a top view of a container with the transportation ring of the present invention affixed thereto.
Figure 4:
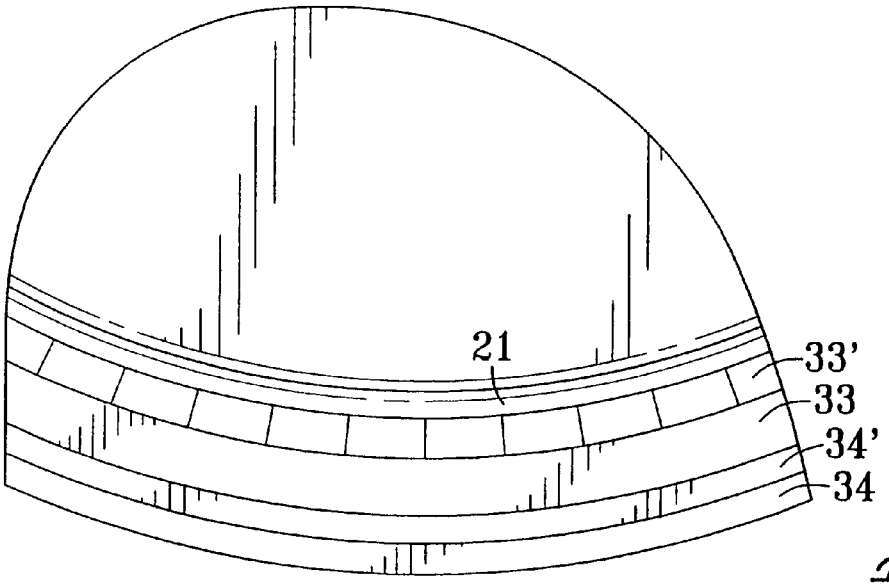
FIG. 4 is an enlarged top view of the container and transportation ring of FIG. 3.

The transportation ring affixed to a container is shown from top view in FIG. 3 where the flat portion 33 is seen with the recess portions 34 and 34' outwardly therefrom. The plug curl and bead contacting arm 32 is positioned inwardly therefrom. One-half of the plug bead 21 is also shown in FIG. 3. These same features are shown in an enlarged view in FIG. 4.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A transportation ring affixed to a container comprising:

a container (11) having a can body (12) extending upwardly to a seam (13) which includes a top surface and a bottom surface which seam (13) connects the can body (12) to a can ring (14), said can ring (14) having a ring well (14'), a U-shaped can ring recess (15) having a can ring recess outer wall (16), a can ring recess inner wall (17) terminating in a can ring curl (18), a can plug (19) having a can plug cover portion (20), a can plug bead (21), a U-shaped plug recess (22) having a plug recess inner wall (23), a plug recess outer wall (24) and a plug curl (25), said U-shaped plug recess (22) being fitted into said U-shaped can ring recess (15) to seal the plug (19) on the can body (12); and a transportation ring (10) mounted on said container (11) and can plug (19), said transportation ring (10) being fabricated from a rigid polymer which is substantially thicker in width than a thickness of said can body (12) and comprising an outer downwardly depending arm (26) surrounding an outer surface of said seam (13), a lower inwardly directed seam locking protrusion (29) extending inwardly from a lower portion (28) of said outer downwardly depending arm (26), said lower inwardly directed seam locking protrusion (29) extending below said seam (13), an upper inwardly extending arm (30) extending inwardly from an upper portion (27) of said outer downwardly depending arm (26), a can seam (13), a plug curl (25) and plug bead (21) contacting arm (32) extending inwardly and in contact with said top surface of said seam (13) and extends under the bottom surface of said seam (13) and contacts said plug curl (25) and downwardly from an inner area (31) of said upper inwardly extending arm (30) to a point in contact with said plug bead (21) and is positioned higher than said plug cover portion (20) and over said plug curl (25) and wherein said can seam (13), plug curl (25) and plug bead (21) contacting arm (32) extends completely above said U-shaped plug recess and into contact with said plug bead (21).

2. The transportation ring (10) affixed to a container of claim 1 wherein said plug curl and plug bead contacting arm (32) has a concave recess (32') shaped to mate with said plug bead (21).

3. The transportation ring (10) affixed to a container of claim 1 wherein said plug curl and plug bead contacting arm (32) is positioned at an angle of about 45 degrees with respect to the horizontal.

4. The transportation ring (10) affixed to a container of claim 1 further including a downwardly depending portion (36) of said outer downwardly depending arm (26) surrounding an outer surface of said seam (13) positioned away from said can body (12) to provide a finger grip on a lowermost portion of said downwardly depending portion (36) of said transportation ring (10).

5. The transportation ring (10) affixed to a container of claim 1 wherein said upper portion (27) of said outer downwardly depending arm contains two recesses (34) and (34') to provide an upper can rest recess (34') and an upper transportation ring recess (34).

* * * * *